US011326234B2

(12) United States Patent
Yokoyama et al.

(10) Patent No.: US 11,326,234 B2
(45) Date of Patent: May 10, 2022

(54) COLD-ROLLED STEEL SHEET AND HOT-DIP GALVANIZED COLD-ROLLED STEEL SHEET

(71) Applicant: NIPPON STEEL CORPORATION, Tokyo (JP)

(72) Inventors: Takafumi Yokoyama, Tokyo (JP); Riki Okamoto, Tokyo (JP); Yuji Yamaguchi, Tokyo (JP); Kazuki Shiokawa, Tokyo (JP); Yuichi Nakahira, Tokyo (JP); Hiroyuki Kawata, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 281 days.

(21) Appl. No.: 16/499,834

(22) PCT Filed: Mar. 31, 2017

(86) PCT No.: PCT/JP2017/013736

§ 371 (c)(1),
(2) Date: Sep. 30, 2019

(87) PCT Pub. No.: WO2018/179386

PCT Pub. Date: Apr. 10, 2018

(65) Prior Publication Data

US 2020/0024709 A1 Jan. 23, 2020

(51) Int. Cl.
*C22C 38/04* (2006.01)
*C21D 8/02* (2006.01)
(Continued)

(52) U.S. Cl.
CPC ..... *C22C 38/04* (2013.01); *C21D 8/0236* (2013.01); *C21D 9/46* (2013.01); *C22C 38/001* (2013.01);
(Continued)

(58) Field of Classification Search
CPC ..... C22C 38/04; C22C 38/002; C22C 38/008; C22C 38/02; C22C 38/06; C22C 38/12;
(Continued)

(56) References Cited

U.S. PATENT DOCUMENTS 9,162,422 B2 10/2015 Kawata et al.
9,896,751 B2 * 2/2018 Kawata ..... C21D 8/0236
(Continued)

FOREIGN PATENT DOCUMENTS

CN 103717773 A 4/2014
EP 2740812 A1 6/2014
(Continued)

OTHER PUBLICATIONS

M Venturino, P. A. Rubini; Coupled Fluid Flow and Heat Transfer Analysis of Steel Reheat Furnaces, 3rd European Conference on Industrial Furnaces on Industrial Furnaces and Boilers (Year: 1995).*
(Continued)

*Primary Examiner* — Nicholas A Wang
*Assistant Examiner* — Maxwell Xavier Duffy
(74) *Attorney, Agent, or Firm* — Birch, Stewart, Kolasch & Birch, LLP

(57) ABSTRACT

A cold-rolled steel sheet is provided that has a tensile strength of 980 MPa or more, and has a prescribed chemical composition. The microstructure is composed of, in area %, ferrite: 1 to 29%, retained austenite: 5 to 20%, martensite: less than 10%, pearlite: less than 5%, and the balance: bainite and/or tempered martensite. The total sum of the lengths of phase boundaries where ferrite comes in contact with martensite or retained austenite having a circle-equivalent radius of 1 μm or more is 100 μm or less per 1000 $\mu m^2$. The cold-rolled steel sheet is excellent in workability and
(Continued)

low-temperature toughness, and in particular is excellent in low-temperature toughness after introduction of plastic strain.

7 Claims, 2 Drawing Sheets

(51) Int. Cl.

| | |
|---|---|
| ***C21D 9/46*** | (2006.01) |
| ***C22C 38/00*** | (2006.01) |
| ***C22C 38/02*** | (2006.01) |
| ***C22C 38/06*** | (2006.01) |
| ***C22C 38/12*** | (2006.01) |
| ***C22C 38/14*** | (2006.01) |
| ***C22C 38/16*** | (2006.01) |
| ***C22C 38/54*** | (2006.01) |
| ***C22C 38/60*** | (2006.01) |
| ***C23C 2/06*** | (2006.01) |

(52) U.S. Cl.
CPC ..... *C22C 38/002* (2013.01); *C22C 38/008* (2013.01); *C22C 38/02* (2013.01); *C22C 38/06* (2013.01); *C22C 38/12* (2013.01); *C22C 38/14* (2013.01); *C22C 38/16* (2013.01); *C22C 38/54* (2013.01); *C22C 38/60* (2013.01); *C23C 2/06* (2013.01); *C21D 2211/001* (2013.01); *C21D 2211/002* (2013.01); *C21D 2211/005* (2013.01); *C21D 2211/008* (2013.01); *C21D 2211/009* (2013.01)

(58) Field of Classification Search
CPC ..... C22C 38/14; C22C 38/16; C22C 38/54; C22C 38/60; C23C 2/06; C21D 8/0236; C21D 9/46; C21D 2211/001; C21D 2211/002; C21D 2211/005; C21D 2211/008; C21D 2211/009
See application file for complete search history.

(56) References Cited

U.S. PATENT DOCUMENTS

| | | | | |
|---|---|---|---|---|
| 10,253,389 | B2 * | 4/2019 | Takashima | C22C 38/28 |
| 2009/0056836 | A1 | 3/2009 | Watanabe et al. | |
| 2009/0314395 | A1 | 12/2009 | Nonaka et al. | |
| 2014/0212684 | A1 | 7/2014 | Kawata et al. | |
| 2014/0342183 | A1 | 11/2014 | Wakabayashi et al. | |
| 2015/0053243 | A1 | 2/2015 | Kim | |
| 2015/0299834 | A1 | 10/2015 | Mizuta et al. | |
| 2016/0208359 | A1 | 4/2016 | Kasuya et al. | |
| 2016/0237520 | A1 | 8/2016 | Murata et al. | |
| 2018/0202016 | A1 | 7/2018 | Yokoyama et al. | |

FOREIGN PATENT DOCUMENTS

| | | | | |
|---|---|---|---|---|
| JP | 2004-68050 | A | 3/2004 | |
| JP | 2006-104532 | A | 4/2006 | |
| JP | 2007-262494 | A | 10/2007 | |
| JP | 2009-108343 | A | 5/2009 | |
| JP | 2011-132602 | A | 7/2011 | |
| JP | 2014-34716 | A | 2/2014 | |
| JP | 2014-133944 | A | 7/2014 | |
| JP | 2015-25208 | A | 2/2015 | |
| JP | 2015-86468 | A | 5/2015 | |
| JP | 2015-200006 | A | 11/2015 | |
| WO | WO 2013/047830 | A1 | 4/2013 | |
| WO | WO 2013/151238 | A1 | 10/2013 | |
| WO | WO-2015151427 | A1 * | 10/2015 | C22C 38/005 |
| WO | WO 2017/002883 | A1 | 1/2017 | |

OTHER PUBLICATIONS

International Preliminary Report on Patentability and Written Opinion of the International Searching Authority (forms PCT/IB/373, PCT/ISA/237 and PCT/IB/326), dated Oct. 10, 2019, for corresponding International Application No. PCT/JP2017/013736, with a Written Opinion translation.

International Search Report (form PCT/ISA/210), dated Jun. 27, 2017, for corresponding International Application No. PCT/JP2017/013736, with an English translation.

Japanese Office Action, dated Sep. 5, 2017, for corresponding Japanese Application No. 2017-538741, with an English translation.

* cited by examiner

COLD-ROLLED STEEL SHEET AND HOT-DIP GALVANIZED COLD-ROLLED STEEL SHEET

TECHNICAL FIELD

The present invention relates to a cold-rolled steel sheet and a hot-dip galvanized cold-rolled steel sheet.

BACKGROUND ART

In recent years, from the viewpoint of complying with greenhouse gas emissions regulations that accompany measures to tackle global warming, improvements in the fuel consumption of automobiles are being sought. In order to reduce the weight of automobile bodies and ensure collision safety, the application of high-strength steel sheets is increasing more and more. Recently, there is an increasing need for ultra-high strength steel sheets having a tensile strength of 980 MPa or more. There is a demand for an ultra-high strength hot-dip galvanized steel sheet whose surface has undergone hot-dip galvanization for use at regions in an automobile body that require rust preventing properties.

Steel sheets that are provided for use in components for automobile use are required to have not only high strength, but also various working properties required when forming components, such as press-formability and weldability. Specifically, from the viewpoint of press-formability, a steel sheet is often required to be excellent in elongation (total elongation in a tensile test: El) and stretch flangeability (hole expansion ratio: λ).

Although it is generally difficult to secure both a high level of total elongation (El) and a high hole expansion ratio (λ) accompanying enhancement of the strength of a steel sheet, a TRIP (transformation induced plasticity) steel sheet is known in which both enhanced strength and workability are achieved by utilizing transformation induced plasticity of retained austenite.

On the other hand, when the application of high-strength steel sheets to automobiles to be used in cold regions is considered, the high-strength steel sheets are required to have properties such that brittle fractures do not occur under a low-temperature environment. In particular, when the application thereof to components for automobile use is considered, low-temperature toughness after plastic strain is introduced by press working is required. However, it is commonly known that a TRIP steel sheet is inferior in low-temperature toughness.

Patent Documents 1 to 3 disclose a technique that relates to high-strength TRIP steel sheets in which constituent fractions of the microstructure are controlled to be within a predetermined range to thereby improve elongation and the hole expansion ratio.

Patent Document 4 and Patent Document 5 disclose a technique that relates to high-strength TRIP steel sheets in which the low-temperature toughness is improved by controlling constituent fractions of the microstructure to be within a predetermined range, and furthermore controlling the distribution of IQ (image quality) values of grains determined by EBSD analysis to be within a predetermined range.

Patent Document 6 discloses a technique that relates to a high-strength TRIP steel in which the microstructure is principally composed of tempered martensite containing retained austenite and MA, and the hole expandability is improved by increasing the proportion of the MA and retained austenite that comes in contact with tempered martensite or that exists within grains of tempered martensite.

Patent Document 7 discloses a technique that improves the toughness of a DP (dual-phase) steel sheet. Patent Document 8 and Patent Document 9 disclose a technique that relates to a high-strength steel sheet in which the low-temperature toughness is improved by controlling constituent fractions of the microstructure to be within a predetermined range, and furthermore controlling the stacking fault density of the retained austenite so as to fall within a predetermined range.

LIST OF PRIOR ART DOCUMENTS

Patent Document

Patent Document 1: WO 2013/151238
Patent Document 2: JP2006-104532A
Patent Document 3: JP2007-262494A
Patent Document 4: JP2015-086468A
Patent Document 5: JP2015-200006A
Patent Document 6: JP2014-34716A
Patent Document 7: JP2011-132602A
Patent Document 8: JP2015-025208A
Patent Document 9: JP2014-133944A

SUMMARY OF INVENTION

Technical Problem

In the techniques disclosed in Patent Documents 1 to 3, consideration is not given to low-temperature toughness. In the technique disclosed in Patent Document 4, because the structural fraction of ferrite is 50% or more, it is difficult to secure a strength of 980 MPa-class or higher. In the technique disclosed in Patent Document 5, consideration is not given to low-temperature toughness after working that is necessary as a steel sheet for automobile use. In the technique disclosed in Patent Document 6, consideration is not given to low-temperature toughness. In the steel sheet disclosed in Patent Document 7, ductility is insufficient since the steel sheet contains almost no retained austenite. In the technique disclosed in Patent Document 8 and Patent Document 9, consideration is not given to hole expandability that is important with regard to the workability of a high-strength steel sheet.

In view of the current state of the prior art, a problem to be solved by the present invention is to increase workability and low-temperature toughness, especially low-temperature toughness after the introduction of plastic strain, in a high-strength cold-rolled steel sheet and a high-strength hot-dip galvanized cold-rolled steel sheet, and an objective of the present invention is to provide a high-strength cold-rolled steel sheet and a high-strength hot-dip galvanized cold-rolled steel sheet that solve the aforementioned problem.

Solution to Problem

In considering approaches for solving the aforementioned problem, the present inventors conducted intensive studies regarding a microstructure with which, in addition to high strength, workability and low-temperature toughness can be secured.

As a result, the present inventors discovered that in order to secure the target strength, elongation, hole expansion ratio and low-temperature toughness, it is necessary for the microstructure to simultaneously satisfy the following conditions (i) to (v).

(i) Ferrite: 1 to 29 area %

(ii) Retained austenite: 5 to 20 area %

(iii) Martensite: less than 10 area %

(iv) Pearlite: less than 5 area %

(v) Bainite and/or tempered martensite: balance

In addition, the present inventors ascertained that the phase boundary between ferrite that has the softest structure in the microstructure and martensite or retained austenite that has the hardest structure becomes a starting point for fractures, and discovered that the low-temperature toughness after working can be further improved if the length of phase boundaries at which both microstructures come in contact is not more than a predetermined value, specifically, if the length satisfies the condition described in (vi) hereunder.

(vi) The total sum of the lengths of phase boundaries at which ferrite comes in contact with martensite or retained austenite having a circle-equivalent radius of 1 μm or more is 100 μm or less per 1000 $\mu m^2$.

FIG. 1 shows results obtained by measuring vTrs when a pre-strain of 5% was applied to steel sheets having various σMA, and thereafter a Charpy impact test was performed. Note that, in the present specification, a total sum of the lengths of phase boundaries at which ferrite comes in contact with martensite or retained austenite having a circle-equivalent radius of 1 μm or more is referred to as "σMA".

As illustrated in FIG. 1, there is a tendency for vTrs after application of 5% pre-strain to decrease as σMA decreases, and in particular vTrs decreases significantly when σMA is 100 μm or less. With regard to the mechanism whereby σMA affects the low-temperature toughness after working, it is considered that when a steel sheet is subjected to working, strain concentrates at phase boundaries between ferrite which is the softest structure in the microstructure and martensite or retained austenite which is the hardest structure in the microstructure, and minute phase boundary separation or cracking occurs. Such phase boundary separation or cracking becomes the starting points for brittle fracture. Hence, it is considered that the smaller the phase boundary is, in other words, the smaller σMA is, the more excellent the low-temperature toughness after working will be.

The present invention has been made based on the aforementioned findings, and the gist of the present invention is as described hereunder.

(1) A cold-rolled steel sheet having a tensile strength of 980 MPa or more, including a chemical composition consisting of, in mass %:

C: 0.10 to 0.30%,
Si: 0.50 to 2.50%,
Mn: 1.50 to 3.50%,
Al: 0.001 to 1.00%,
P: 0.05% or less,
S: 0.01% or less,
N: 0.01% or less,
O: 0.01% or less,
Cr: 0 to 1.00%,
Mo: 0 to 1.00%,
Sn: 0 to 1.00%,
Cu: 0 to 1.00%,
Ni: 0 to 1.00%,
B: 0 to 0.005%,
Ti: 0 to 0.30%,
V: 0 to 0.50%,
Nb: 0 to 0.10%,
W: 0 to 0.50%,
Ca: 0 to 0.010%,
Mg: 0 to 0.010%,
Sb: 0 to 0.200%,
Zr: 0 to 0.010%,
Bi: 0 to 0.010%,
REM: 0 to 0.100%, and
the balance: Fe and impurities,
wherein:
a microstructure consists of, in area %:
ferrite: 1 to 29%,
retained austenite: 5 to 20%,
martensite: less than 10%,
pearlite: less than 5%, and
the balance: bainite and/or tempered martensite; and
a total sum of lengths of phase boundaries where ferrite comes in contact with martensite or retained austenite having a circle-equivalent radius of 1 μm or more is 100 μm or less per 1000 $\mu m^2$.

(2) The cold-rolled steel sheet according to the above (1), wherein a thickness of the steel sheet is in a range of 0.5 to 3.2 mm.

(3) A hot-dip galvanized cold-rolled steel sheet, including: a hot-dip galvanized layer on a surface of the cold-rolled steel sheet according to the above (1) or (2).

(4) A hot-dip galvanized cold-rolled steel sheet, including: a galvannealed layer on a surface of the cold-rolled steel sheet according to the above (1) or (2).

Advantageous Effects of Invention

According to the present invention, a high-strength cold-rolled steel sheet and a high-strength hot-dip galvanized cold-rolled steel sheet can be provided which are excellent in workability and low-temperature toughness, and in particular, are excellent in low-temperature toughness after plastic strain introduction.

DESCRIPTION OF EMBODIMENTS

Figure 1:
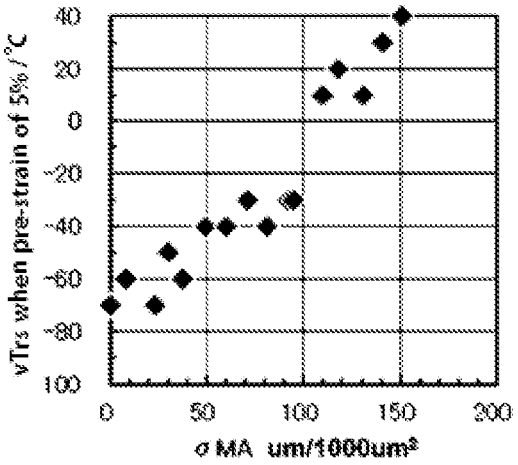
FIG. 1 is a view illustrating the relation between vTrs after application of a pre-strain of 5%, and σMA.

Hereunder, a steel sheet according to the present invention and a plated steel sheet according to the present invention as well as methods for producing the steel sheet and the plated steel sheet are described in order.

First, the reasons for limiting the chemical composition of the steel sheet according to the present invention will be described. Hereunder, the symbol "%" in relation to the chemical composition means "mass %".

Chemical Composition

C: 0.10 to 0.30%

C (carbon) is an element that is essential for securing the strength of the steel sheet. In order to obtain sufficiently high strength, the content of C is made 0.10% or more. Preferably, the content of C is 0.13% or more, 0.15% or more, 0.17% or more, or 0.18% or more. On the other hand, if the C content is excessive, C will cause the workability and weldability to decrease. Therefore, the content of C is set to be not more than 0.30%. To suppress the occurrence of a decrease in the press-formability and weldability, a preferable content of C is 0.27% or less, 0.25% or less, 0.23% or less, or 0.21% or less.

Si: 0.50 to 2.50%

Si (silicon) is an element that suppresses the formation of iron carbides, and contributes to improving strength and formability. To obtain these effects, the content of Si is made 0.50% or more. In order to suppress the precipitation of iron-based carbides, a preferable content of Si is 0.65% or more, 0.80% or more, 0.90% or more, 1.00% or more, 1.10% or more, or 1.20% or more. On the other hand, an excessive Si content will cause a cast slab to crack and also cause embrittlement of the steel sheet. Therefore, the content of Si is made 2.50% or less. Furthermore, in an annealing process, Si forms oxides on the steel sheet surface and is thus detrimental to the chemical treatability and plating adhesion. Therefore, the content of Si is preferably 2.25% or less, 2.00% or less, 1.85% or less, 1.70% or less, or 1.60% or less. More preferably, the content of Si is 1.50% or less.

Mn: 1.50 to 3.50%

Mn (manganese) is an element that increases the hardenability of the steel sheet and contributes to improving the strength. If the content of Mn is less than 1.50%, the hardenability of the steel sheet will be insufficient, a large amount of ferrite will precipitate during cooling after annealing, and it will be difficult to secure the required strength. Hence, the content of Mn is made 1.50% or more. Preferably, the content of Mn is 1.80% or more, 2.00% or more, 2.20% or more, or 2.30% or more. On the other hand, if the Mn content is excessive, Mn segregation will occur and will cause a decrease in the workability and toughness. Therefore, the content of Mn is made not more than 3.50%. From the viewpoint of securing weldability, a preferable content of Mn is 3.00% or less. A more preferable content of Mn is 2.80% or less, 2.70% or less, 2.60% or less, or 2.50% or less.

Al: 0.001 to 1.00%

Al (aluminum) is a deoxidizing element. To obtain this effect, the content of Al is made 0.001% or more. Preferably, the content of Al is 0.005% or more, 0.010% or more, or 0.015% or more. On the other hand, even if a surplus amount of Al is contained, the effect of addition will be saturated and the economic efficiency will decrease, and in addition, the transformation temperature of the steel will rise and the load during hot rolling will increase. Therefore, the content of Al is made 1.00% or less. Preferably, the content of Al is 0.50% or less, 0.20% or less, 0.10% or less, 0.060% or less, or 0.040% or less.

P: 0.05% or Less

P (phosphorus) is an element that contributes to enhancing the strength by solid-solution strengthening. If the content of P is more than 0.05% the weldability and toughness will decrease. Therefore, the content of P is made 0.05% or less. Preferably the content of P is 0.02% or less, or 0.015% or less. It is not necessary to particularly limit the lower limit of the P content, and the lower limit thereof is 0%. However, since reducing the P content to less than 0.001% will cause a significant rise in the production cost, 0.001% may be set as the lower limit.

S: 0.01% or Less

S (sulfur) is an impurity element, and is an element that forms MnS and hinders the workability and weldability. Therefore, the S content is made 0.01% or less. The S content is preferably 0.005% or less or 0.003% or less, and more preferably is 0.002% or less. It is not necessary to particularly limit the lower limit of the S content, and the lower limit thereof is 0%. Reducing the S content to less than 0.0005% will cause a significant rise in the production cost, and therefore 0.0005% may be set as the lower limit.

N: 0.01% or Less

N (nitrogen) is an impurity element, and is an element that forms coarse nitrides and hinders the workability and toughness. Therefore, the content of N is made 0.01% or less. A preferable N content is 0.007% or less, 0.005% or less, or 0.004% or less. It is not necessary to particularly limit the lower limit of the N content, and the lower limit thereof is 0%. Since reducing the N content to less than 0.0005% will cause a significant rise in the production cost, 0.0005% may be set as the lower limit.

O: 0.01% or Less

O (oxygen) is an impurity element, and is an element that forms coarse oxides and hinders the bendability and hole expandability. Therefore, the content of O is made 0.01% or less. Preferably, the content of O is 0.005% or less, or 0.003% or less. It is not necessary to particularly limit the lower limit of the O content, and the lower limit thereof is 0%. Since reducing the O content to less than 0.0001% will cause a significant rise in the production cost, 0.0001% may be set as the lower limit.

As necessary, the steel sheet according to the present invention may contain the respective elements described hereunder.

Cr: 0 to 1.00%
Mo: 0 to 1.00%
Sn: 0 to 1.00%
Cu: 0 to 1.00%
Ni: 0 to 1.00%
B: 0 to 0.005%

Cr (chromium), Mo (molybdenum), Sn (tin), Cu (copper), Ni (nickel) and B (boron) are elements that each contribute to enhancing the steel sheet strength, and therefore one or more of these elements may be contained. However, when an excessive amount of these elements is contained, the effect of addition will be saturated and the economic efficiency will decrease. Therefore, the upper limit of the respective contents of Cr, Mo, Sn, Cu and Ni is set as 1.00%, and the upper limit of the content of B is set as 0.0050%. A more preferable upper limit is 0.60%, 0.40%, 0.20%, 0.10% or 0.050% for each of Cr, Mo, Ni, Sn, Cu and Ni, and is 0.0020% or 0.0030% for B. To sufficiently obtain the aforementioned effect, 0.001% may be set as the lower limit of the content of Cr, Mo, Sn, Cu and Ni, and 0.0001% may be set as the lower limit of the content of B. A more preferable lower limit is 0.010% or 0.020% for each of Cr, Mo, Sn, Cu and Ni, and is 0.0005% or 0.0010% for B. It is not essential to obtain the aforementioned effect. Therefore, it is not necessary to particularly limit the lower limit of the respective contents of Cr, Mo, Sn, Cu and Ni, and the lower limit of each of these contents is 0%.

Ti: 0 to 0.30%
V: 0 to 0.50%
Nb: 0 to 0.10%
W: 0 to 0.50%

Ti (titanium), V (vanadium), Nb (niobium) and W (tungsten) are elements that each form carbides and contribute to enhancing the steel sheet strength, and therefore one or more of these elements may be contained. However, when an excessive amount of these elements is contained, the effect of addition will be saturated and the economic efficiency will decrease. Therefore, the upper limit of the content of Ti is set to 0.30%, the upper limit of the content of V is set to 0.50%, the upper limit of the content of Nb is set to 0.10%, and the upper limit of the content of W is set to 0.50%. A more preferable upper limit of Ti is 0.15% or 0.05%. A more preferable upper limit of V is 0.30% or 0.08%. A more preferable upper limit of Nb is 0.05% or 0.02%. A more preferable upper limit of W is 0.25% or 0.05%. To sufficiently obtain the aforementioned effect, the lower limit of the respective contents of Ti, V, Nb and W is preferably 0.001% or 0.005%. A more preferable lower limit of the content of each of these elements is 0.010%. It is not essential to obtain the aforementioned effect. Therefore, it is not necessary to particularly limit the lower limit of the respective contents of Ti, V, Nb and W, and the lower limit of each of these contents is 0%.

Ca: 0 to 0.010%,
Mg: 0 to 0.010%,
Sb: 0 to 0.200%,
Zr: 0 to 0.010%,
Bi: 0 to 0.010%,
REM: 0 to 0.100%,

Ca (calcium), Mg (magnesium), Sb (antimony), Zr (zirconium) and REM are elements that finely disperse inclusions in the steel, and thereby contribute to improving the workability. Bi (bismuth) is an element that reduces microsegregation of substitutional alloying elements such as Mn and Si in the steel, and thereby contributes to improving the workability. Hence, one or more kinds of these elements may be contained. However, if the content of these elements is excessive, the ductility will decrease. Therefore, the upper limit of the respective contents of Ca and Mg is 0.010%, the upper limit of the content of Sb is 0.200%, the upper limit of the content of Zr and Bi is 0.010%, and the upper limit of the content of REM is 0.100%. A more preferable upper limit of Ca and Mg is 0.005% or 0.003%, of Sb is 0.150% or 0.05%, of Zr and Bi is 0.005% or 0.002%, and of REM is 0.050% or 0.004%. To sufficiently obtain the aforementioned effects, it is preferable to set the lower limit of the respective contents of Ca and Mg as 0.0001%, the lower limit of the respective contents of Sb and Zr as 0.001% or 0.005%, and the lower limit of the respective contents of Bi and REM as 0.0001% or 0.005%. A more preferable lower limit of Ca and Mg is 0.0010%, of Sb and Zr is 0.008%, and of Bi and REM is 0.0008%. It is not essential to obtain the aforementioned effect. Therefore, it is not necessary to particularly limit the lower limit of the respective contents of Ca, Mg, Sb, Zr and REM, and the lower limit of each of these contents is 0%. Note that, the term "REM" is a generic term used to refer collectively to a total of 17 elements including Sc, Y and lanthanoids, and the content of REM means the total amount of the aforementioned elements.

In the chemical composition of the steel sheet according to the present invention, the balance apart from the aforementioned elements is Fe and impurities, and elements which are unavoidably mixed into the steel from the steel raw materials and/or during the steelmaking process may be contained within a range which is not detrimental to the properties of the steel sheet according to the present invention.

Next, the reasons for limiting the microstructure of the steel sheet according to the present invention will be described. Hereunder, the symbol "%" as used in relation to the microstructure means "area %".

Microstructure
Ferrite: 1 to 29%
Retained austenite: 5 to 20%
Martensite: less than 10%
Pearlite: less than 5%
Balance: bainite and/or tempered martensite In the steel sheet according to the present invention, the aforementioned microstructure is formed and required mechanical properties are secured.

Ferrite is a microstructure that is effective for securing sufficient elongation, and hence the ferrite amount is made 1% or more. A preferable lower limit is 3%, 5%, 7% or 9%. A more preferable lower limit is 10%, 11%, 12% or 13%. On the other hand, because it is difficult to secure sufficient strength in a case where the ferrite amount is excessive, the ferrite amount is set to not more than 29%. A preferable upper limit is 27%, 25%, 22% or 20%. A more preferable upper limit is 19% or 18%.

Retained austenite is also a microstructure that is effective for securing sufficient elongation, and hence the retained austenite amount is made 5% or more. A preferable lower limit is 7%, 8% or 9%. A more preferable lower limit is 10% or 11%. On the other hand, because it is difficult to secure sufficient strength in a case where the retained austenite amount is excessive, the retained austenite amount set to not more than 20%. A preferable upper limit is 17%, 16%, 15% or 14%.

If the respective amounts of martensite and pearlite are excessive, sufficient hole expandability and low-temperature toughness cannot be secured. Therefore, the martensite amount is set to less than 10%, and the pearlite amount is set to less than 5%. A preferable upper limit of the martensite amount is 8%, 6%, 5% or 4%, and a preferable upper limit of the pearlite amount is 3%, 2% or 1%. A more preferable upper limit is less than 1%. It is not particularly necessary to set a lower limit for these amounts, and the lower limit is 0%. However, in the steel sheet according to the present invention, martensite is often present to a certain extent, and, as necessary, the lower limit of the martensite amount may be set as 1%, 2%, 3% or 4%. Although the pearlite amount is preferably 0%, the lower limit thereof may be 0.5% or 1%.

The balance of the microstructure is bainite and/or tempered martensite. An upper limit of the balance microstructure is 94%, and a lower limit is more than 36%. The lower limit may be 40%, 50%, 55%, 60%, 65% or 70%, and the upper limit may be 90%, 86%, 82%, 78% or 74%. In particular, the tempered martensite amount is preferably 65% or less, or 60% or less, and the tempered martensite amount is preferably 30% or more, or 40% or more.

A method for calculating the area percentage of the microstructure of the steel sheet according to the present invention will now be described. A section in the rolling direction of the steel sheet is cut out, the microstructure is revealed by etching using a nital solution, the microstructure at a position of ¼ thickness of the steel sheet is photographed using a scanning electron microscope (magnification: ×5000, 5 visual fields), and area fractions (area %) are calculated by the point counting method based on the obtained microstructure photograph.

A region in which a substructure does not appear and in which the brightness is low is taken as being ferrite, and a region in which a substructure does not appear and in which the brightness is high is taken as being martensite or retained austenite, and the area fractions of these regions are calculated. A region in which a substructure appears is taken as being tempered martensite or bainite, and the area fraction thereof is calculated.

Regarding the area fraction of retained austenite, X-ray diffraction is performed in a plane located at a position at ¼ of the thickness of the steel sheet as the observation surface, and a value calculated based on a peak area ratio for bcc and fcc is taken as the area fraction. The area fraction of martensite is determined by subtracting the area fraction of retained austenite obtained using X-ray diffraction from an area fraction calculated as martensite or retained austenite.

A structural fraction obtained by X-ray diffraction is, originally, a volume ratio (vol %). However, since an area fraction (area %) of the microstructure is substantially equal to the volume ratio (vol %), the percentage of retained austenite measured by X-ray diffraction as described above is taken as it is to be the area fraction of retained austenite.

Bainite and tempered martensite can be distinguished by observing the positions and variants of cementite included within the structure. Tempered martensite is constituted of martensite laths and cementite that formed within the laths. At this time, because two or more kinds of relationships exist with respect to the crystal orientation relationship between the martensite laths and cementite, the cementite constituting a part of the tempered martensite has a plurality of variants.

Bainite is classified into upper bainite and lower bainite. Upper bainite is composed of lath-type bainitic ferrite and cementite that formed at the lath interface, and therefore it can be easily distinguished from tempered martensite. Lower bainite is composed of lath-type bainitic ferrite and cementite that formed within the laths. In this case, unlike tempered martensite, there is only one kind of crystal orientation relationship between bainitic ferrite and cementite, and therefore the cementite constituting the lower bainite has the same variant. Accordingly, lower bainite and tempered martensite can be distinguished based on the variants of cementite.

Total sum of lengths of phase boundaries when ferrite comes in contact with martensite or retained austenite having a circle-equivalent radius of 1 μm or more: 100 μm or less per 1000 $\mu m^2$ If the circle-equivalent radius of martensite or retained austenite is large, the martensite or retained austenite will be detrimental to workability and toughness. In particular, in a case where martensite or retained austenite having a circle-equivalent radius of 1 μm or more comes in contact with ferrite that is soft structure, it causes the workability and toughness to deteriorate. Therefore, it is necessary to manage the total sum of the lengths of the phase boundaries at which ferrite comes in contact with martensite or retained austenite having a circle-equivalent radius of 1 μm or more.

The total sum of the lengths of the phase boundaries is determined as follows.

First, an obtained microstructure photograph is separated into the following three regions: (1) ferrite, (2) martensite or retained austenite, and (3) other microstructures. The term "(3) other microstructures" refers to a region in which a substructure appears in the microstructure photograph as mentioned above, and corresponds to bainite and/or tempered martensite.

Next, using a commercially available application for image analysis, the areas of martensite and retained austenite are respectively determined, and the obtained values are converted to a circle-equivalent radius. A boundary line with ferrite is traced for all of the martensite or the retained austenite that has a circle-equivalent radius of 1 μm or more, and the lengths are calculated. The total sums of the lengths are then determined, and multiplied by 1000 ($\mu m^2$)/measurement visual field area ($\mu m^2$).

The application for image analysis used at this time may be any application that can perform the aforementioned operations, and although no particular application is specified here, for example the application is Image-Pro Plus, Ver. 6.1 (Media Cybernetics, Inc.).

To secure the required workability and toughness, the total sum of the lengths of the phase boundaries at which ferrite comes in contact with martensite or retained austenite having a circle-equivalent radius of 1 μm or more is made 100 μm or less per 1000 $\mu m^2$. With respect to further improving the toughness, the aforementioned total sum of the lengths of the phase boundaries is preferably 80 μm or less, 70 μm or less, or 60 μm or less. More preferably, the aforementioned total sum of the lengths of the phase boundaries is 50 μm or less or 40 μm or less.

Next, preferable mechanical properties of the steel sheet according to the present invention are described.

Tensile strength: 980 MPa or more

Total elongation: 10% or more

Hole expansion ratio: 30% or more vTrs after 5% pre-strain: −10° C. or less

To secure the strength required as a steel sheet for an automobile, the tensile strength of the steel sheet according to the present invention is preferably 980 MPa or more. Although it is not particularly necessary to set an upper limit of the tensile strength, the upper limit may be 1250 MPa, 1200 MPa or 1150 MPa. In order to secure workability that enables the steel sheet to be formed into various shapes by press working or the like as a steel sheet for an automobile, preferably the total elongation is 10% or more and the hole expansion ratio is 30% or more. Further, in order to secure low-temperature toughness as a steel sheet for an automobile for use in cold regions, vTrs after 5% pre-strain is preferably −10° C. or less. Preferably vTrs after 5% pre-strain is −30° C. or less.

The thickness of the steel sheet according to the present invention is mainly in the range of 0.5 to 3.2 mm, although there are also cases where the thickness is less than 0.5 mm or where the thickness is more than 3.2 mm.

A plated steel sheet according to the present invention is a cold-rolled steel sheet having a hot-dip galvanized layer on the surface of the steel sheet according to the present invention, or is a cold-rolled steel sheet that has a galvannealed layer. Corrosion resistance is further improved by the presence of a hot-dip galvanized layer on the steel sheet surface. Excellent weldability and coating properties can be secured by the presence of a galvannealed layer in which Fe is incorporated into a hot-dip galvanized layer by an alloying treatment on the surface of the steel sheet.

In the plated steel sheet according to the present invention, plating of an upper layer may be performed on the hot-dip galvanized layer or galvannealed layer for the purpose of improving the coating properties and weldability. Further, in the steel sheet according to the present invention, various kinds of treatment such as a chromate treatment, a phosphate treatment, a lubricity enhancing treatment, or a weldability enhancing treatment may be performed on the hot-dip galvanized layer or galvannealed layer.

Next, a production method that is suitable for producing the steel sheet according to the present invention will be described.

When producing the steel sheet according to the present invention, the following processes (A) to (C) for processing a cast piece having the chemical composition of the steel sheet according to the present invention are important. The present inventors have confirmed by studies performed up to now that if the following conditions are satisfied, the microstructure and the like of the present invention can be obtained.

(A) Hot rolling process according to conditions (A1) to (A4)

A hot rolling process is performed according to the following conditions.

(A1) Slab Heating that Satisfies Formula (1)

[Expression 1]

$$10^4 \cdot \frac{\sum_{Ac1}^{Ac3} f\gamma \mathrm{WMn}\ \gamma\sqrt{D(T)\cdot ts(T)}}{\sum_{Ac3}^{SRT}\sqrt{D(T)\cdot ts(T)}} \leqq 1.0 \quad (1)$$

where $$f\gamma = \frac{\mathrm{WC}}{0.8} + \left(1 - \frac{\mathrm{WC}}{0.8}\right)\cdot\frac{T - Ac1}{Ac3 - Ac1}$$

$$\mathrm{WMn}\ \gamma = \left\{3.4\cdot\mathrm{WMn} - 2.4\cdot\mathrm{WMn}\cdot\frac{T - Ac1}{Ac3 - Ac1}\right\}/100$$

$$D = 10^{-4.8}\cdot\exp\left(\frac{-262000}{R\cdot T}\right)$$

$T$: temperature (° C.)

$R$: gas constant; 8.314 J/mol $ts(T)$: residence time of slab at temperature T (sec)

$SRT$: slab heating temperature (° C.)

WC: C content in steel (mass %)

WMn: Mn content in steel (mass %)

The left side of formula (1) is a formula that represents the degree of non-uniformity of the Mn concentration that occurs during slab heating. The numerator on the left side of formula (1) is a term that represents the Mn amount distributed from a to γ while in an α+γ dual-phase region during slab heating, and the larger that this value is, the greater the degree of non-uniformity of the Mn concentration distribution in the slab. On the other hand, the denominator on the left side of formula (1) is a term that corresponds to a distance between Mn atoms that diffuse in γ while in a γ single-phase region during slab heating, and the larger that this value is, the greater the degree of uniformity of the Mn concentration distribution in the slab. In other words, the longer that the residence time of the slab in the α+γ dual-phase region ($Ac_1$ or higher to not higher than $Ac_3$) is, the greater the amount of Mn that will be distributed from α to γ. On the other hand, the longer that the residence time of the slab in they single-phase temperature range ($Ac_3$ or higher) is, the greater that the degree of uniformity of the Mn concentration distribution will be.

The larger that the left-hand value in formula (1) is, the greater the amount of Mn-rich regions in which the Mn concentration is locally high that will be formed in the steel. Further, Mn-poor regions are formed around the Mn-rich regions. These regions continue to be present through hot rolling and cold rolling until a final annealing process. Because the hardenability is low in the Mn-poor regions, the Mn-poor regions easily transform preferentially to ferrite in the final annealing process. Because the hardenability is high in the Mn-rich regions that exist adjacent to the Mn-poor regions, it is difficult for ferrite transformation and bainite transformation to occur in the final annealing process, and the Mn-rich regions easily transform to martensite. Accordingly, when the Mn concentration is non-uniform, because it is easy for ferrite and martensite to be formed adjacent to one another, σMA that is the total sum of the lengths of the phase boundaries at which ferrite comes in contact with martensite or retained austenite increases.

Figure 2:
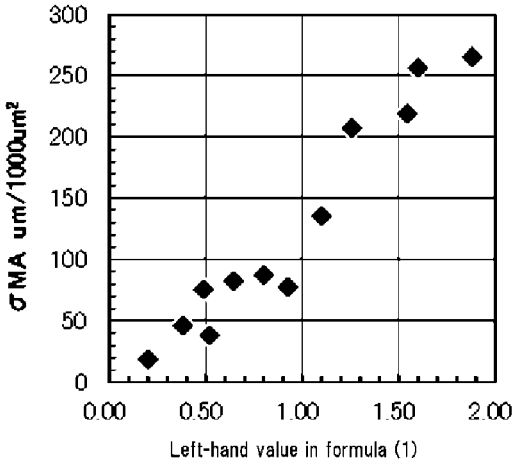
FIG. 2 is a view showing results obtained by investigating the relation between a left-hand value of formula (1) and σMA.

FIG. 2 is a view showing results obtained by investigating the relation between the left-hand value in formula (1) and σMA. The value of σMA increases together with an increase in the left-hand value in formula (1), and in particular the value of σMA rapidly increases at the point at which the left-hand value in formula (1) becomes more than 1.0. Because of the situation described above, in order to make the Mn concentration distribution sufficiently uniform in the steel, it is necessary to select the slab heating conditions so that the left-hand value in formula (1) becomes 1.0 or less. Note that, $Ac_1$ and $Ac_3$ are calculated based on the following empirical equations. The symbol of an element means the element amount (mass %).

$$Ac_1 = 723 - 10.7\ \mathrm{Mn} - 16.9\ \mathrm{Ni} + 29.1\ \mathrm{Si} + 16.9\ \mathrm{Cr}$$

$$Ac_3 = 910 - 203\cdot\sqrt{\mathrm{C}} - 15.2\ \mathrm{Ni} + 44.7\ \mathrm{Si} + 104\ \mathrm{V} + 31.5\ \mathrm{Mo} - 30\ \mathrm{Mn} - 11\ \mathrm{Cr} - 20\ \mathrm{Cu} + 700\ \mathrm{P} + 400\ \mathrm{Al} + 400\ \mathrm{Ti}$$

Note that, each symbol of an element in the above equations represents the content (mass %) of the respective elements.

Figure 3:
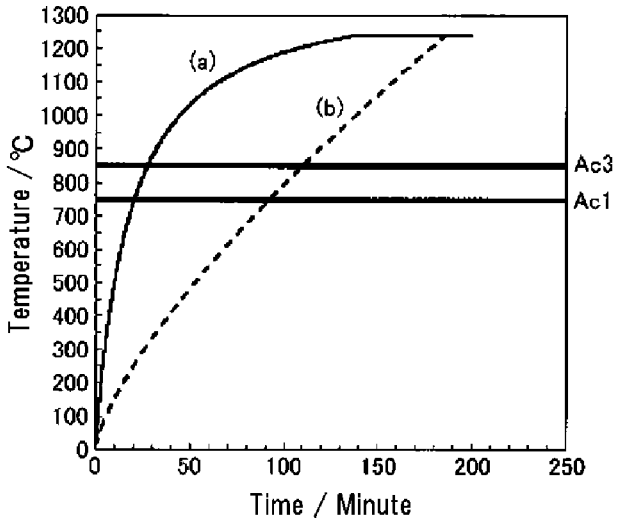
FIG. 3 is a view illustrating examples of a slab heating pattern.

Examples of slab heating patterns are shown in FIG. 3. In FIG. 3, (a) denotes a slab heating pattern of No. 1 (example in accordance with the present invention; left-hand value in formula (1) is 0.52<1.0) in Table 2 (shown later), and (b) denotes a slab heating pattern of No. 2 (comparative example; left-hand value in formula (1) is 1.25>1.0) in Table 2 (shown later). It will be understood that the slab heating pattern (a) and the slab heating pattern (b) differ noticeably. Note that the slab heating temperature is preferably 1200° C. or higher and not more than 1300° C.

(A2) Total Rolling Reduction in Range from 1050° C. or More to not More than 1150° C.: 60% or More Rough rolling is performed at a temperature that is 1050° C. or higher and is not more than 1150° C., in which the total rolling reduction is 60% or more. If the total rolling reduction is less than 60% at a temperature that is 1050° C. or higher and not more than 1150° C., there is a risk that recrystallization during rolling will be insufficient and this will lead to non-uniformity of the microstructure of the hot-rolled sheet, and therefore the aforementioned total rolling reduction is set as 60% or more.

(A3) Total Rolling Reduction from 1050° C. or Less to Before Final Pass of Finish Rolling (Final Finishing Pass): 70 to 95%

Rolling reduction in final finishing pass: 10 to 25%

Temperature for final finishing pass: 880 to 970° C.

In a case where the total rolling reduction from a temperature of 1050° C. or less to before the final finishing pass is less than 70%, a case where the rolling reduction in the final finishing pass is less than 10%, or a case where the temperature for the final finishing pass is more than 970° C., the microstructure of the hot-rolled sheet coarsens, the microstructure of the final product sheet coarsens, and the workability deteriorates. Therefore, the total rolling reduction from a temperature of 1050° C. or less to before the final finishing pass is made 70% or more, the rolling reduction in the final finishing pass is made 10% or more, and the temperature (entrance-side temperature) for the final finishing pass is made 970° C. or less.

On the other hand, in a case where the total rolling reduction from a temperature of 1050° C. or less to before the final finishing pass is more than 95%, a case where the rolling reduction in the final finishing pass is more than 25%, or a case where the temperature for the final finishing pass is less than 880° C., an aggregate structure of the hot-rolled steel sheet develops and anisotropy occurs in the final product sheet. Therefore, the total rolling reduction from a temperature of 1050° C. or less to before the final finishing pass is made not more than 95%, the rolling reduction in the final finishing pass is made not more than 25%, and the temperature (entrance-side temperature) for the final finishing pass is set to 880° C. or higher.

(A4) Coiling Temperature: 430 to 650° C.

If the coiling temperature is less than 430° C., the strength of the hot-rolled steel sheet will be excessive and cold rolling properties will be impaired. Therefore, the coiling temperature is set to 430° C. or higher. On the other hand, if the coiling temperature is more than 650° C., Mn will concentrate in cementite in the hot-rolled steel sheet and the Mn concentration distribution will become non-uniform or the pickling properties will decrease. Therefore, the coiling temperature is set to 650° C. or less.

Note that, pickling of the hot-rolled steel sheet may be performed in the usual manner. Further, skin pass rolling may be performed in order to straighten the shape of the hot-rolled steel sheet and improve the pickling properties.

(B) Rolling Reduction: 30% or More to not More than 80% in Cold Rolling Process

In a final annealing process, since it is necessary to refine the austenite grain size, the rolling reduction is made 30% or more. On the other hand, if the rolling reduction is more than 80%, the applied rolling load will be excessive and the load on the rolling mill will increase, and therefore the rolling reduction is made 80% or less.

(C) Continuous Annealing Process by Way of Processes of (C1) to (C5)

(C1) Heating temperature: $Ac_3$−30° C. or more to not more than 900° C.

Heating time period (retention time): 30 secs or more to not more than 450 secs If the heating temperature is less than $Ac_3$−30° C., austenitization does not progress sufficiently, and therefore the heating temperature is set to a temperature equivalent to $Ac_3$−30° C. or higher. On the other hand, if the heating temperature is more than 900° C., the austenite grain size will coarsen and the toughness and chemical treatability will decrease, and there is also a risk that the annealing facilities will be damaged. Therefore, the heating temperature is set to not more than 900° C.

If the heating time period is less than 30 seconds, austenitization will not progress sufficiently. Therefore, the heating time period is set to 30 seconds or more. On the other hand, if the heating time period is more than 500 seconds, productivity will decrease. Therefore, the heating time period is set to not more than 450 seconds.

(C2) Primary Cooling

Cooling rate: 5.0° C./sec or less, primary cooling finish temperature: 620 to 720° C.

In order to control ferrite fraction and pearlite fraction to within a required range, primary cooling and then secondary cooling (described later) are performed after the aforementioned heating. Since the required ferrite fraction will not be obtained if the cooling rate in the primary cooling is more than 5.0° C./sec or if the primary cooling finish temperature is more than 720° C., the cooling rate is set to 5.0° C./sec or less and the primary cooling finish temperature is set to not more than 720° C. On the other hand, since the required ferrite fraction will not be obtained if the primary cooling finish temperature is less than 620° C., the primary cooling finish temperature is set to not less than 620° C.

(C3) Secondary Cooling

Cooling rate: 20° C./sec or more

Secondary cooling finish temperature: 280 to 350° C.

The conditions for the secondary cooling after the primary cooling are as described above. If the secondary cooling rate is less than 20° C./sec, the required ferrite fraction and pearlite fraction will not be obtained. If the secondary cooling finish temperature is lower than 280° C., the untransformed austenite fraction will decrease noticeably, and consequently the retained austenite fraction will be below the required value. If the secondary cooling finish temperature is higher than 350° C., bainite transformation will not progress sufficiently in a tertiary cooling process thereafter, and hence the secondary cooling finish temperature is set to not more than 350° C. Note that the secondary cooling start temperature is the same as the primary cooling finish temperature.

(C4) Low-Temperature Heating (Low-temperature) Heating temperature: 390 to 430° C.

(Low-temperature) Heating time period (retention time): 10 secs or less

Low-temperature heating is performed immediately after secondary cooling. If the heating temperature is lower than 390° C. or if the heating temperature is higher than 430° C., bainite transformation will not progress sufficiently during subsequent tertiary cooling, and the degree of stability of the austenite will decrease. Although it is not necessary to particularly limit the heating rate, heating at a rate of 1° C./sec or more is preferable from the viewpoint of production efficiency. The low-temperature heating time period is set to not more than 10 seconds.

(C5) Tertiary Cooling

Tertiary cooling finish temperature: 280 to 350° C.

Cooling rate: 0.15 to 1.5° C./sec

Tertiary cooling is performed immediately after the low-temperature heating in order to stabilize the austenite (austempering). Although an austempering treatment is normally performed by holding the steel at a constant temperature, the degree of stability of austenite can be further enhanced by performing slow cooling and not isothermal holding of the steel. The tertiary cooling finish temperature is set in the range of 280 to 330° C. Note that the tertiary cooling start temperature is the same as the heating temperature during low-temperature heating.

Although the detailed mechanism whereby the degree of stability of austenite is improved more by slow cooling than by isothermal holding is not clear, in the case of isothermal holding, bainite transformation stops at the time point at which the C concentration in untransformed austenite reaches a $T_0$ composition (C concentration in austenite at time when the free energy of the austenite phase (FCC structure) and the ferritic phase (BCC structure) become equal, and the driving force for bainite transformation becomes 0) at the isothermal holding temperature. In contrast, in the case of slow cooling, because the $T_0$ composition increases moment by moment accompanying a decrease in the temperature produced by slow cooling, the C concentration in untransformed austenite increases more than in the case of isothermal holding. It is considered that, as a result, the degree of stability of untransformed austenite increases further.

Figure 4:
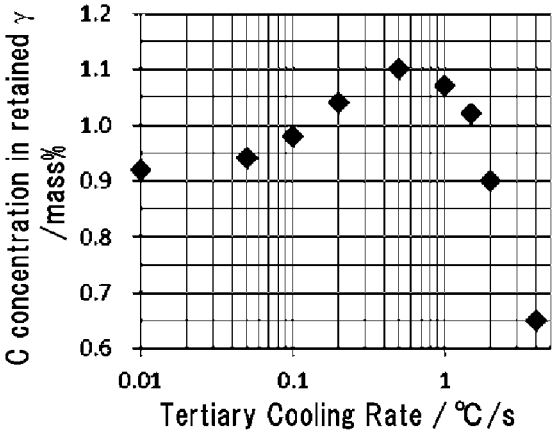
FIG. 4 is a view illustrating the relation between a tertiary cooling rate and a C concentration in retained γ (Cγ).

FIG. 4 is a view showing the relation between the tertiary cooling rate and the C concentration in retained γ (Cγ). As shown in FIG. 4, it is found that Cγ is maximized when the tertiary cooling rate is within the range of 0.15 to 1.5° C./s.

After the aforementioned continuous annealing, the steel sheet may be subjected to temper rolling for the purpose of flatness correction and adjustment of the degree of surface roughness. In this case, it is preferable to make the rate of elongation 2% or less to avoid a deterioration in ductility.

Next, a method for producing the plated steel sheet according to the present invention will be described.

The method for producing the plated steel sheet according to the present invention includes the processes in the following (D) and (E), after the processes of (A) to (C) that are described above.

(D) Plating process of forming a hot-dip galvanized layer on the surface of the steel sheet according to the present invention that was produced by the processes in (A) to (C) that are described above.

(E) Alloying process of forming a galvannealed layer by performing an alloying treatment after forming a hot-dip galvanized layer on the surface of the steel sheet according to the present invention that was produced by the processes in (A) to (C) that are described above.

The respective processes are described hereunder.

(D) Plating Process

The steel sheet according to the present invention is dipped in a hot-dip galvanizing bath to form a hot-dip galvanized layer on the steel sheet surface. Formation of the hot-dip galvanized layer may be performed consecutively after the aforementioned continuous annealing. The hot-dip galvanizing bath is a plating bath that has zinc as a main constituent, and the hot-dip galvanizing bath may be a plating bath that has a zinc alloy as a main constituent. The temperature of the plating bath is preferably in the range of 450 to 470° C.

(E) Alloying Process

An alloying treatment is performed on the hot-dip galvanized layer formed on the steel sheet surface to thereby form a galvannealed layer. Although the conditions for the alloying treatment are not particularly limited to specific conditions, it is preferable to perform the alloying treatment by heating to a temperature within the range of 480 to 600° C., and holding at that temperature for 2 to 100 secs.

EXAMPLES

Examples of the present invention will now be described. However, the conditions adopted in the Examples are merely one example of conditions adopted to confirm the operability and advantageous effects of the present invention, and the present invention is not limited to this one example of the conditions. The present invention can adopt various conditions as long as the objective of the present invention is achieved without departing from the gist of the present invention.

Examples

Slabs having the chemical compositions shown in Table 1 were cast, and hot rolling was performed under the conditions shown in Table 2 and Table 3 to make hot-rolled steel sheets. Each hot-rolled steel sheet was subjected to pickling, and cold rolling was then performed under the rolling reduction conditions shown in Table 2 and Table 3 to form cold-rolled steel sheets. Each cold-rolled steel sheet was subjected to a heat treatment under the conditions shown in Table 2 and Table 3.

TABLE 1

| Steel | Chemical Composition (mass %; balance: Fe and impurities) | | | | | | | | | | | | |
|---|---|---|---|---|---|---|---|---|---|---|---|---|---|
| Type | C | Si | Mn | Al | P | S | N | O | Other | | | $Ac_1$ | $Ac_3$ |
| A | 0.16 | 1.64 | 2.38 | 0.027 | 0.010 | 0.0018 | 0.0037 | 0.0022 | | | | 745 | 849 |
| B | 0.20 | 0.97 | 2.41 | 0.024 | 0.008 | 0.0016 | 0.0033 | 0.0029 | | | | 725 | 805 |
| C | 0.18 | 1.78 | 2.65 | 0.021 | 0.011 | 0.0014 | 0.0034 | 0.0030 | | | | 746 | 840 |
| D | 0.21 | 1.51 | 2.56 | 0.018 | 0.012 | 0.0020 | 0.0038 | 0.0015 | | | | 740 | 823 |
| E | 0.11 | 1.53 | 2.79 | 0.020 | 0.011 | 0.0017 | 0.0036 | 0.0016 | | | | 738 | 843 |
| F | 0.16 | 1.23 | 1.89 | 0.020 | 0.010 | 0.0015 | 0.0035 | 0.0021 | Cr: 0.41 | | | 745 | 838 |
| G | 0.17 | 1.16 | 1.99 | 0.023 | 0.013 | 0.0010 | 0.0030 | 0.0013 | Cu: 0.20 | Ni: 0.38 | | 729 | 827 |
| H | 0.22 | 1.16 | 2.25 | 0.025 | 0.010 | 0.0019 | 0.0037 | 0.0012 | Mo: 0.15 | W: 0.14 | | 733 | 821 |
| I | 0.15 | 1.39 | 2.00 | 0.023 | 0.009 | 0.0009 | 0.0032 | 0.0019 | V: 0.10 | Nb: 0.020 | | 742 | 859 |
| J | 0.15 | 1.41 | 2.25 | 0.021 | 0.010 | 0.0012 | 0.0036 | 0.0025 | Ti: 0.030 | Nb: 0.020 | | 740 | 854 |
| K | 0.22 | 1.52 | 1.63 | 0.026 | 0.009 | 0.0010 | 0.0029 | 0.0023 | Mo: 0.21 | Ti: 0.018 | B: 0.0016 | 750 | 864 |
| L | 0.19 | 1.64 | 2.48 | 0.020 | 0.013 | 0.0008 | 0.0033 | 0.0018 | Ti: 0.022 | B: 0.0017 | | 744 | 846 |
| M | 0.16 | 1.42 | 2.30 | 0.022 | 0.010 | 0.0013 | 0.0031 | 0.0015 | Ca: 0.0027 | Mg: 0.0049 | | 740 | 839 |
| N | 0.18 | 1.35 | 2.27 | 0.027 | 0.011 | 0.0015 | 0.0034 | 0.0020 | Bi: 0.0071 | REM: 0.110 | | 738 | 835 |
| O | 0.17 | 1.85 | 2.67 | 0.025 | 0.012 | 0.0017 | 0.0035 | 0.0011 | Sn: 0.20 | | | 748 | 847 |
| P | 0.19 | 1.86 | 2.50 | 0.024 | 0.007 | 0.0020 | 0.0040 | 0.0026 | Sb: 0.10 | | | 750 | 844 |
| Q | 0.21 | 1.34 | 2.03 | 0.019 | 0.001 | 0.0017 | 0.0032 | 0.0023 | Zr: 0.0120 | REM: 0.110 | | 740 | 824 |
| a | 0.07* | 1.56 | 2.58 | 0.023 | 0.008 | 0.0015 | 0.0034 | 0.0022 | | | | 741 | 863 |
| b | 0.15 | 1.52 | 3.98* | 0.028 | 0.012 | 0.0016 | 0.0030 | 0.0019 | | | | 725 | 800 |
| c | 0.16 | 0.38* | 2.55 | 0.026 | 0.012 | 0.0022 | 0.0031 | 0.0022 | | | | 707 | 788 |

*Means value is outside range defined by the present invention.

TABLE 2

| | | Hot Rolling Conditions | | | | | | | Cold Rolling Condition |
|---|---|---|---|---|---|---|---|---|---|
| No. | Steel Type | Formula (1) left-hand value | SRT [° C.] | R1 [%] | R2 [%] | R3 [%] | FT [° C.] | CT [° C.] | Rolling reduction [%] |
| 1 | A | 0.52 | 1240 | 74 | 88 | 15 | 930 | 600 | 52 |
| 2 | A | 1.25# | 1240 | 74 | 88 | 15 | 910 | 560 | 52 |

TABLE 2-continued

| No. | Steel Type | Hot Rolling Conditions: Formula (1) left-hand value | SRT [° C.] | R1 [%] | R2 [%] | R3 [%] | FT [° C.] | CT [° C.] | Cold Rolling Condition: Rolling reduction [%] |
|---|---|---|---|---|---|---|---|---|---|
| 3 | A | 0.68 | 1250 | 74 | 88 | 15 | 930 | 560 | 52 |
| 4 | A | 0.64 | 1240 | 74 | 88 | 15 | 930 | 560 | 52 |
| 5 | A | 0.92 | 1250 | 74 | 90 | 12 | 930 | 580 | 52 |
| 6 | A | 0.49 | 1250 | 74 | 88 | 15 | 900 | 580 | 52 |
| 7 | A | 0.52 | 1240 | 74 | 88 | 15 | 930 | 600 | 52 |
| 8 | A | 0.52 | 1240 | 74 | 88 | 15 | 930 | 600 | 52 |
| 9 | A | 0.52 | 1240 | 74 | 88 | 15 | 930 | 600 | 52 |
| 10 | A | 0.52 | 1240 | 74 | 88 | 15 | 930 | 600 | 52 |
| 11 | A | 0.52 | 1240 | 74 | 88 | 15 | 930 | 600 | 52 |
| 12 | B | 0.62 | 1240 | 74 | 88 | 18 | 940 | 570 | 60 |
| 13 | C | 0.78 | 1250 | 74 | 88 | 15 | 920 | 600 | 52 |
| 14 | C | 0.78 | 1250 | 74 | 88 | 15 | 920 | 600 | 52 |
| 15 | C | 0.78 | 1250 | 74 | 88 | 15 | 920 | 600 | 52 |
| 16 | D | 0.78 | 1250 | 74 | 88 | 15 | 930 | 550 | 52 |
| 17 | E | 0.66 | 1250 | 74 | 88 | 15 | 930 | 560 | 52 |
| 18 | E | 0.59 | 1260 | 74 | 88 | 15 | 950 | 510 | 52 |
| 19 | F | 0.65 | 1250 | 74 | 88 | 18 | 940 | 580 | 60 |
| 20 | G | 0.60 | 1250 | 74 | 88 | 18 | 930 | 550 | 60 |
| 21 | H | 0.46 | 1250 | 74 | 88 | 15 | 950 | 590 | 52 |
| 22 | I | 0.96 | 1240 | 74 | 88 | 15 | 900 | 580 | 52 |
| 23 | J | 0.69 | 1260 | 74 | 88 | 15 | 910 | 560 | 52 |
| 24 | K | 0.74 | 1250 | 74 | 88 | 15 | 930 | 570 | 52 |
| 25 | L | 0.77 | 1250 | 74 | 88 | 15 | 930 | 590 | 52 |
| 26 | M | 0.72 | 1250 | 74 | 88 | 15 | 920 | 600 | 52 |
| 27 | N | 0.64 | 1230 | 74 | 88 | 15 | 930 | 570 | 52 |
| 28 | O | 0.75 | 1250 | 74 | 88 | 15 | 900 | 560 | 52 |
| 29 | P | 0.68 | 1250 | 74 | 88 | 15 | 920 | 550 | 52 |
| 30 | Q | 0.39 | 1250 | 74 | 88 | 15 | 920 | 560 | 52 |
| 31 | a* | 0.80 | 1250 | 74 | 88 | 15 | 940 | 570 | 52 |
| 32 | b* | 0.74 | 1250 | 74 | 88 | 15 | 940 | 580 | 52 |
| 33 | c* | 0.40 | 1250 | 74 | 88 | 18 | 950 | 550 | 60 |
| 34 | A | 0.54 | 1250 | 74 | 88 | 15 | 920 | 540 | 52 |
| 35 | A | 0.64 | 1250 | 74 | 88 | 15 | 940 | 560 | 52 |
| 36 | A | 0.52 | 1240 | 74 | 88 | 15 | 930 | 600 | 52 |

*Means value is outside range defined by the present invention.
#Means value deviates from the preferable production conditions.

Where, the meaning of the respective symbols in the table is as follows.

SRT: slab heating temperature

R1: total rolling reduction at 1050 to 1150° C.

R2: total rolling reduction from 1050° C. or less to before final finishing pass R3: rolling reduction in final finishing pass FT: entrance-side temperature for final finishing pass CT: coiling temperature

TABLE 3

| No. | Continuous Annealing Conditions: T1 [° C.] | t1 [sec] | CR1 sec | T2 [° C.] | CR2 [° C./sec] | T3 [° C.] | HR [° C./sec] | T4 [° C.] | t2 [sec] | CR3 [° C./sec] | T5 [° C.] | Surface |
|---|---|---|---|---|---|---|---|---|---|---|---|---|
| 1 | 850 | 108 | 3.3 | 670 | 50 | 330 | 10 | 390 | 5 | 0.20 | 310 | CR |
| 2 | 850 | 108 | 3.7 | 650 | 50 | 320 | 10 | 390 | 5 | 0.23 | 300 | CR |
| 3 | 810# | 108 | 2.0 | 700 | 50 | 330 | 10 | 390 | 5 | 0.23 | 300 | CR |
| 4 | 830 | 108 | 2.4 | 700 | 50 | 330 | 10 | 400 | 5 | 0.56 | 280 | CR |
| 5 | 860 | 108 | 3.3 | 680 | 50 | 350 | 10 | 400 | 5 | 0.25 | 300 | CR |
| 6 | 840 | 108 | 5.4# | 550# | 50 | 300 | 10 | 410 | 5 | 0.23 | 320 | CR |
| 7 | 840 | 108 | 2.8 | 690 | 50 | 310 | 10 | 400 | 5 | 0.00# | 400# | CR |
| 8 | 840 | 108 | 2.8 | 690 | 50 | 300 | 10 | 400 | 5 | 1.33 | 200# | CR |
| 9 | 840 | 108 | 2.8 | 690 | 50 | 300 | 10 | 350# | 5 | 0.20 | 270# | CR |
| 10 | 840 | 108 | 3.0 | 680 | 50 | 280 | 10 | 420 | 5 | 0.25 | 320 | CR |
| 11 | 830 | 108 | 2.8 | 680 | 5# | 310 | 10 | 400 | 5 | 0.25 | 300 | CR |
| 12 | 820 | 108 | 2.6 | 680 | 50 | 350 | 10 | 400 | 5 | 0.20 | 320 | CR |
| 13 | 850 | 108 | 3.1 | 680 | 50 | 280 | 10 | 390 | 5 | 0.15 | 330 | CR |
| 14 | 820 | 108 | 2.2 | 700 | 50 | 290 | 10 | 390 | 5 | 0.18 | 320 | CR |

TABLE 3-continued

| | Continuous Annealing Conditions | | | | | | | | | | | |
|---|---|---|---|---|---|---|---|---|---|---|---|---|
| No. | T1 [° C.] | t1 [sec] | CR1 sec | T2 [° C.] | CR2 [° C./sec] | T3 [° C.] | HR [° C./sec] | T4 [° C.] | t2 [sec] | CR3 [° C./sec] | T5 [° C.] | Surface |
| 15 | 870 | 108 | 1.9 | 770# | 50 | 290 | 10 | 390 | 5 | 0.18 | 320 | CR |
| 16 | 840 | 108 | 2.8 | 690 | 50 | 300 | 10 | 390 | 5 | 0.15 | 330 | CR |
| 17 | 850 | 108 | 3.7 | 650 | 50 | 350 | 10 | 400 | 5 | 0.20 | 320 | CR |
| 18 | 850 | 108 | 3.5 | 660 | 50 | 310 | 10 | 410 | 5 | 0.23 | 320 | CR |
| 19 | 850 | 108 | 3.3 | 670 | 50 | 320 | 10 | 410 | 5 | 0.28 | 300 | CR |
| 20 | 830 | 108 | 2.8 | 680 | 50 | 340 | 10 | 400 | 5 | 0.28 | 290 | CR |
| 21 | 830 | 108 | 3.3 | 650 | 50 | 290 | 10 | 390 | 5 | 0.15 | 330 | CR |
| 22 | 850 | 108 | 3.3 | 670 | 50 | 300 | 10 | 400 | 5 | 0.25 | 300 | CR |
| 23 | 860 | 108 | 3.1 | 690 | 50 | 300 | 10 | 400 | 5 | 0.23 | 310 | CR |
| 24 | 880 | 108 | 4.3 | 650 | 50 | 310 | 10 | 390 | 5 | 0.18 | 310 | CR |
| 25 | 850 | 108 | 4.1 | 630 | 50 | 280 | 10 | 400 | 5 | 0.23 | 310 | CR |
| 26 | 860 | 108 | 3.5 | 670 | 50 | 300 | 10 | 410 | 5 | 0.33 | 280 | CR |
| 27 | 830 | 108 | 2.8 | 680 | 50 | 350 | 10 | 410 | 5 | 0.20 | 330 | CR |
| 28 | 860 | 108 | 3.3 | 680 | 50 | 280 | 10 | 390 | 5 | 0.18 | 320 | CR |
| 29 | 860 | 108 | 3.5 | 670 | 50 | 290 | 10 | 400 | 5 | 0.30 | 280 | CR |
| 30 | 850 | 108 | 3.5 | 660 | 50 | 300 | 10 | 400 | 5 | 0.18 | 330 | CR |
| 31 | 880 | 108 | 3.7 | 680 | 50 | 340 | 10 | 400 | 5 | 0.25 | 300 | CR |
| 32 | 830 | 108 | 3.3 | 650 | 50 | 290 | 10 | 400 | 5 | 0.23 | 310 | CR |
| 33 | 830 | 108 | 2.6 | 690 | 50 | 300 | 10 | 400 | 5 | 0.20 | 320 | CR |
| 34 | 840 | 108 | 3.1 | 670 | 30 | 300 | 10 | 400 | 5 | 0.18 | 330 | GA |
| 35 | 840 | 108 | 3.0 | 680 | 30 | 300 | 10 | 400 | 5 | 0.18 | 330 | GI |
| 36 | 830 | 108 | 2.8 | 680 | 50 | 320 | 10 | 400 | 60# | 0.20 | 320 | CR |

#Means value deviates from the preferable production conditions.

Where, the meaning of the respective symbols in the table is as follows.

T1: heating temperature t1: heating time period

CR1: primary cooling rate

T2: primary cooling finish temperature (secondary cooling start temperature)

CR2: secondary cooling rate

T3: secondary cooling finish temperature

HR: heating rate

T4: low-temperature heating temperature t2: low-temperature heating time period

CR3: tertiary cooling rate

T5: tertiary cooling finish temperature

CR: cold-rolled steel sheet

GI: hot-dip galvanized steel sheet

GA: galvannealed steel sheet

In accordance with JIS Z 2241, a No. 5 tensile test specimen was taken from a direction orthogonal to rolling direction from each of the cold-rolled steel sheets after heat treatment, and a tensile test was performed and the tensile strength (TS), yield strength (YS) and total elongation (EL) were measured. Further, a hole expanding test was performed in accordance with JIS Z 2256, and the hole expansion ratio (λ) was measured.

Next, strain (pre-strain working) was applied to the steel sheet by performing cold rolling at a rate of elongation of 5% on the cold-rolled steel sheet after the heat treatment, and thereafter a Charpy test specimen was prepared, and the low-temperature toughness after working was evaluated by determining the brittle-ductile transition temperature (vTrs). As the Charpy test specimen, a plurality of steel sheets were superposed and fastened with bolts, and after confirming that there were no clearances between the steel sheets, a test specimen with a v-notch having a depth of 2 mm was prepared. The number of the steel sheets that were superposed was set so that the test specimen thickness after lamination was as close as possible to 10 mm. For example, in a case where the sheet thickness was 1.2 mm, eighth steel sheets were superposed to make the test specimen thickness 9.6 mm. In the laminated Charpy test specimen, the sheet width direction was taken as the longitudinal direction. Note that, although it is simpler and easier not to laminate the test specimens and to perform a Charpy impact test with a single test specimen, the test specimens were laminated because use of a laminated test specimen results in stricter test conditions.

Measurement was performed at intervals of 20° C. in the range of the test temperature of −120° C. to +20° C., and a temperature at which the brittle fracture rate was 50% was taken to be the transition temperature (vTrs). The conditions other than those mentioned above were in accordance with JIS Z 2242. For reference purposes, the low-temperature toughness (vTrs) prior to application of the pre-strain was also evaluated.

The results are shown in Table 4.

TABLE 4

| | | Microstructure | | | | | | Mechanical Properties | | | | | | |
|---|---|---|---|---|---|---|---|---|---|---|---|---|---|---|
| No. | Steel Type | Vα [%] | VP [%] | VM [%] | Vγ [%] | Balance [%] | σMA [μm/1000 μm²] | YS [MPa] | TS [MPa] | El [%] | λ [%] | vTrs [° C.] | Post-working vTrs [° C.] | Surface |
| 1 | A | 17 | 0 | 4 | 10 | 69 | 38 | 697 | 1018 | 21.2 | 54 | −60 | −30 | CR |
| 2# | A | 14 | 0 | 6 | 11 | 69 | 207* | 592 | 996 | 22.0 | 18$ | −10 | >20$ | CR |
| 3# | A | 24 | 0 | 6 | 11 | 59 | 169* | 574 | 1003 | 22.7 | 25$ | −10 | >20$ | CR |
| 4 | A | 17 | 0 | 7 | 10 | 66 | 83 | 621 | 1019 | 20.4 | 38 | −40 | −20 | CR |

TABLE 4-continued

| | | Microstructure | | | | | | Mechanical Properties | | | | | | |
|---|---|---|---|---|---|---|---|---|---|---|---|---|---|---|
| No. | Steel Type | Vα [%] | VP [%] | VM [%] | Vγ [%] | Balance [%] | σMA [μm/1000 μm²] | YS [MPa] | TS [MPa] | El [%] | λ [%] | vTrs [° C.] | Post-working vTrs [° C.] | Surface |
| 5 | A | 9 | 0 | 6 | 10 | 75 | 78 | 789 | 1069 | 17.5 | 44 | −40 | −30 | CR |
| 6# | A | 39* | 0 | 7 | 12 | 42 | 76 | 556 | 984 | 24.5 | 23$ | −10 | 0$ | CR |
| 7# | A | 18 | 0 | 6 | 11 | 65 | 108* | 706 | 1079 | 19.6 | 30 | −20 | 0$ | CR |
| 8# | A | 17 | 0 | 12* | 8 | 63 | 180* | 712 | 1178 | 13.2 | 23$ | −10 | >20$ | CR |
| 9# | A | 18 | 0 | 12* | 11 | 59 | 156* | 701 | 1066 | 18.8 | 33 | −20 | >20$ | CR |
| 10 | A | 20 | 0 | 1 | 7 | 72 | 9 | 803 | 1064 | 15.2 | 63 | −100 | −70 | CR |
| 11# | A | 57* | 2 | 4 | 12 | 25 | 87 | 496 | 891$ | 29.5 | 32 | −40 | −20 | CR |
| 12 | B | 8 | 0 | 5 | 10 | 77 | 30 | 778 | 1045 | 17.1 | 60 | −80 | −60 | CR |
| 13 | C | 10 | 0 | 5 | 8 | 77 | 45 | 914 | 1190 | 16.3 | 54 | −80 | −50 | CR |
| 14 | C | 20 | 0 | 2 | 10 | 68 | 35 | 852 | 1194 | 18.2 | 50 | −60 | −40 | CR |
| 15# | C | 0* | 0 | 5 | 9 | 86 | 0 | 1053 | 1298 | 9.2$ | 62 | −80 | −50 | CR |
| 16 | D | 15 | 0 | 4 | 8 | 73 | 61 | 900 | 1227 | 17.6 | 55 | −60 | −40 | CR |
| 17 | E | 13 | 0 | 4 | 7 | 76 | 30 | 720 | 994 | 17.1 | 65 | −80 | −60 | CR |
| 18 | E | 10 | 0 | 2 | 7 | 81 | 16 | 785 | 1011 | 15.8 | 69 | −80 | −70 | CR |
| 19 | F | 15 | 0 | 4 | 9 | 72 | 36 | 659 | 1003 | 19.0 | 51 | −70 | −60 | CR |
| 20 | G | 18 | 0 | 4 | 9 | 69 | 43 | 666 | 1021 | 18.6 | 53 | −70 | −60 | CR |
| 21 | H | 7 | 0 | 5 | 13 | 75 | 14 | 884 | 1200 | 16.2 | 58 | −80 | −70 | CR |
| 22 | I | 19 | 0 | 5 | 11 | 65 | 90 | 625 | 982 | 24.4 | 32 | −30 | −10 | CR |
| 23 | J | 21 | 0 | 4 | 13 | 62 | 79 | 641 | 999 | 22.7 | 46 | −50 | −30 | CR |
| 24 | K | 6 | 0 | 6 | 15 | 73 | 42 | 896 | 1214 | 16.1 | 62 | −60 | −40 | CR |
| 25 | L | 8 | 0 | 3 | 10 | 79 | 56 | 947 | 1225 | 15.4 | 66 | −60 | −50 | CR |
| 26 | M | 12 | 0 | 4 | 10 | 74 | 34 | 645 | 1033 | 20.2 | 52 | −60 | −40 | CR |
| 27 | N | 22 | 0 | 4 | 12 | 62 | 77 | 596 | 988 | 25.3 | 36 | −30 | −20 | CR |
| 28 | O | 10 | 0 | 3 | 9 | 78 | 20 | 862 | 1201 | 17.7 | 51 | −80 | −60 | CR |
| 29 | P | 12 | 0 | 4 | 10 | 74 | 24 | 875 | 1189 | 18.1 | 54 | −80 | −60 | CR |
| 30 | Q | 23 | 0 | 3 | 12 | 62 | 13 | 718 | 1021 | 23.0 | 56 | −80 | −50 | CR |
| 31 | a* | 20 | 0 | 2 | 6 | 72 | 10 | 611 | 910$ | 25.6 | 70 | −80 | −50 | CR |
| 32 | b* | 5 | 0 | 18* | 7 | 70 | 75 | 902 | 1326 | 12.6 | 10$ | 0 | >20$ | CR |
| 33 | c* | 23 | 0 | 0 | 2* | 75 | 0 | 594 | 895$ | 19.9 | 68 | −80 | −70 | CR |
| 34 | A | 16 | 0 | 5 | 10 | 69 | 32 | 619 | 997 | 22.3 | 57 | −80 | −50 | GA |
| 35 | A | 18 | 0 | 5 | 11 | 66 | 44 | 651 | 1010 | 24.5 | 50 | −80 | −80 | GI |
| 36# | A | 20 | 0 | 8 | 13 | 59 | 115* | 644 | 1065 | 20.8 | 26$ | −20 | >20$ | CR |

*Means value is outside range defined by the present invention.
#Means value deviates from the preferable production conditions.
$Means value does not satisfy the preferable mechanical properties.

Where, the meaning of the respective symbols in the table is as follows.

Vα: area fraction of ferrite

VP: area fraction of pearlite

VM: area fraction of martensite

Vγ: area fraction of retained austenite balance: area fraction of bainite and/or tempered martensite σMA: total sum of lengths of phase boundaries where ferrite comes in contact with martensite or retained austenite having a circle-equivalent radius of 1 μm or more (μm/1000 μm²)

YS: yield strength

TS: tensile strength

El: total elongation

λ: hole expansion ratio vTrs: transition temperature

In the examples in which the chemical composition and production conditions were within the ranges of the present invention, since the microstructure fractions were within the ranges of the present invention, the tensile strength was 980 MPa or more, the elongation was 10% or more, the hole expansion ratio was 30% or more, and vTrs after application of 5% pre-strain was −10° C. or less. In contrast, in the examples in which either or both of the chemical composition and production conditions were outside the ranges of the present invention, one or more of the tensile strength, elongation, hole expansion ratio, and vTrs after application of 5% pre-strain did not reach the required value.

INDUSTRIAL APPLICABILITY

As described in the foregoing, according to the present invention, a high-strength cold-rolled steel sheet and a high-strength hot-dip galvanized cold-rolled steel sheet that are excellent in workability and low-temperature toughness, and in particular are excellent in low-temperature toughness after introduction of plastic strain can be provided. Hence, the applicability of present invention to the steel sheet production industry and industries that utilize steel sheets is high.

The invention claimed is:

1. A cold-rolled steel sheet having a tensile strength of 980 MPa or more, and comprising a chemical composition consisting of, in mass %:

C: 0.10 to 0.30%,

Si: 0.50 to 2.50%,

Mn: 1.50 to 3.50%,

Al: 0.001 to 1.00%,

P: 0.05% or less,

S: 0.01% or less,

N: 0.01% or less,

O: 0.01% or less,

Cr: 0 to 1.00%,

Mo: 0 to 1.00%,

Sn: 0 to 1.00%,

Cu: 0 to 1.00%,

Ni: 0 to 1.00%,

B: 0 to 0.005%,

Ti: 0 to 0.30%,

V: 0 to 0.50%,
Nb: 0 to 0.10%,
W: 0 to 0.50%,
Ca: 0 to 0.010%,
Mg: 0 to 0.010%,
Sb: 0 to 0.200%,
Zr: 0 to 0.010%,
Bi: 0 to 0.010%,
REM: 0 to 0.100%, and
the balance: Fe and impurities,
wherein:
a microstructure consists of, in area %:
ferrite: 1 to 29%,
retained austenite: 5 to 20%,
martensite: less than 10%,
pearlite: less than 5%, and
the balance: bainite and/or tempered martensite; and
a total sum of lengths of phase boundaries where ferrite comes in contact with martensite or retained austenite, said martensite or retained austenite having a circle-equivalent radius of 1 μm or more, is 100 μm or less per 1000 $\mu m^2$.

2. The cold-rolled steel sheet according to claim 1, wherein:
a thickness of the steel sheet is in a range of 0.5 to 3.2 mm.

3. A hot-dip galvanized cold-rolled steel sheet, comprising:
a hot-dip galvanized layer on a surface of the cold-rolled steel sheet according to claim 2.

4. A hot-dip galvanized cold-rolled steel sheet, comprising:
a galvannealed layer on a surface of the cold-rolled steel sheet according to claim 2.

5. A hot-dip galvanized cold-rolled steel sheet, comprising:
a hot-dip galvanized layer on a surface of the cold-rolled steel sheet according to claim 1.

6. A hot-dip galvanized cold-rolled steel sheet, comprising:
a galvannealed layer on a surface of the cold-rolled steel sheet according to claim 1.

7. A cold-rolled steel sheet having a tensile strength of 980 MPa or more, and comprising a chemical composition comprising, in mass %:
C: 0.10 to 0.30%,
Si: 0.50 to 2.50%,
Mn: 1.50 to 3.50%,
Al: 0.001 to 1.00%,
P: 0.05% or less,
S: 0.01% or less,
N: 0.01% or less,
O: 0.01% or less,
Cr: 0 to 1.00%,
Mo: 0 to 1.00%,
Sn: 0 to 1.00%,
Cu: 0 to 1.00%,
Ni: 0 to 1.00%,
B: 0 to 0.005%,
Ti: 0 to 0.30%,
V: 0 to 0.50%,
Nb: 0 to 0.10%,
W: 0 to 0.50%,
Ca: 0 to 0.010%,
Mg: 0 to 0.010%,
Sb: 0 to 0.200%,
Zr: 0 to 0.010%,
Bi: 0 to 0.010%,
REM: 0 to 0.100%, and
the balance comprising: Fe and impurities,
wherein:
a microstructure comprising, in area %:
ferrite: 1 to 29%,
retained austenite: 5 to 20%,
martensite: less than 10%,
pearlite: less than 5%, and
the balance: bainite and/or tempered martensite; and
a total sum of lengths of phase boundaries where ferrite comes in contact with martensite or retained austenite, said martensite or retained austenite having a circle-equivalent radius of 1 μm or more, is 100 μm or less per 1000 $\mu m^2$.

* * * * *